United States Patent [19]

Seng et al.

[11] 4,451,933

[45] Jun. 5, 1984

[54] COSTUME MASK ARMATURE

[76] Inventors: Mary L. Seng, 2345 Liberty St., Allentown, Pa. 18104; Judith A. Wanfried, 218 N. Jefferson St., Allentown, Pa. 18102; Robert H. Beisel, 173 W. 78th St., Apt. 15D, New York, N.Y. 10024

[21] Appl. No.: 343,429

[22] Filed: Jan. 28, 1982

[51] Int. Cl.[3] ..... A42B 1/04

[52] U.S. Cl. ..... 2/202; 2/173; 2/205; 2/206

[58] Field of Search ..... 2/9, 6, 173, 202, 205, 2/206, 422, 416; 318/158; 46/1 F, 22

[56] References Cited

U.S. PATENT DOCUMENTS

| | | | |
|---|---|---|---|
| 171,492 | 2/1954 | Erickson et al. | 2/205 |
| 1,251,657 | 1/1918 | Hart | 2/205 |
| 1,391,753 | 9/1921 | Baier | 2/416 |
| 1,510,145 | 2/1922 | Huson | 2/202 |
| 1,856,879 | 5/1932 | Lufkin | 2/205 |
| 2,058,989 | 7/1935 | Isaac | 2/173 |
| 2,637,038 | 5/1953 | Bower | 2/206 |
| 2,642,574 | 2/1952 | Eloranta | 2/205 |
| 2,722,688 | 3/1963 | Wojnar | 2/205 |
| 2,914,772 | 1/1959 | Lemelson | 2/206 |
| 3,373,446 | 3/1968 | Verderame | 2/173 |
| 3,668,705 | 6/1972 | Garbisch | 2/173 |

FOREIGN PATENT DOCUMENTS

| | | | |
|---|---|---|---|
| 1096832 | 2/1955 | France | 2/206 |

OTHER PUBLICATIONS

*Journal of A.M.A.*, vol. 168 No. 7, Gersham, "Self-Adhering Nylon Tapes".

*Primary Examiner*—Werner H. Schroeder
*Assistant Examiner*—Mary A. Ellis
*Attorney, Agent, or Firm*—Ruth Moyerman

[57] ABSTRACT

A universal costume mask armature is disclosed in which a rigid, preferably lattice, infrastructure including skull-shaped cranium and face portion is utilized. The face portion is preferably generally flattened and includes a pair of eye ports. A nose plate between the eye ports forms a continuation of the face and serves to receive and support nose features of a mask mounted on the armature. The face portion also includes a maxilary plate located below the nose plate to receive and support upper lip features of a mask. Use of this armature will enable a very wide range and variety of masks to be interchanged because the construction of the face portion of the armature is designed to support unlimited combinations of nose, eyebrows, beak, etc. without regard to their weight or size.

10 Claims, 12 Drawing Figures

FIG. 2
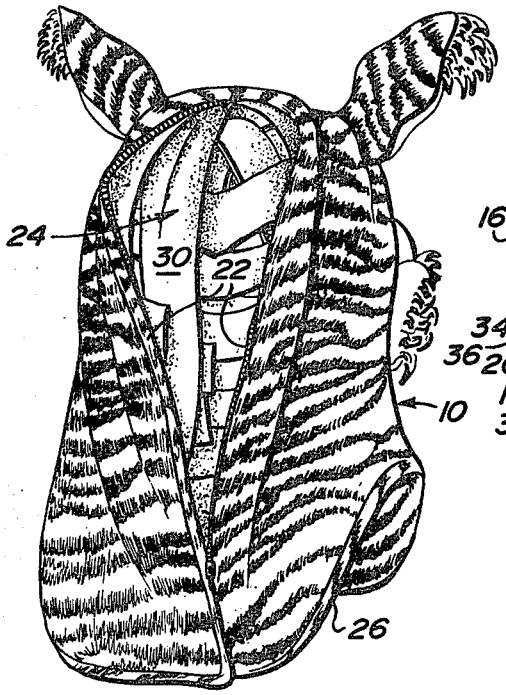
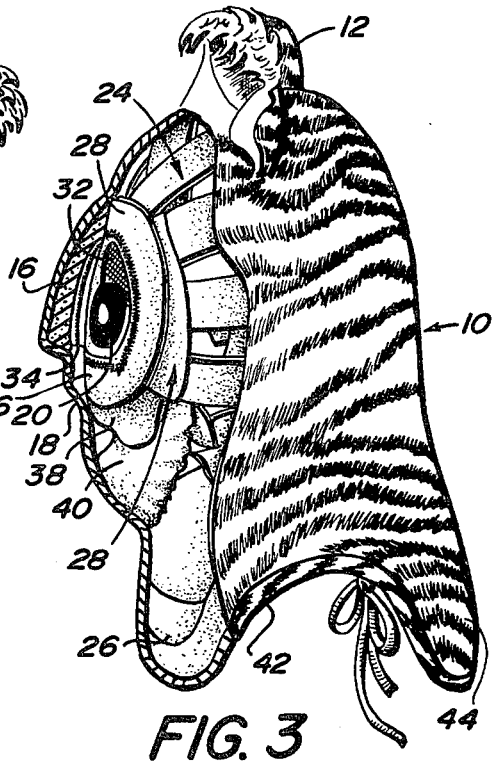
FIG. 3
FIG. 1
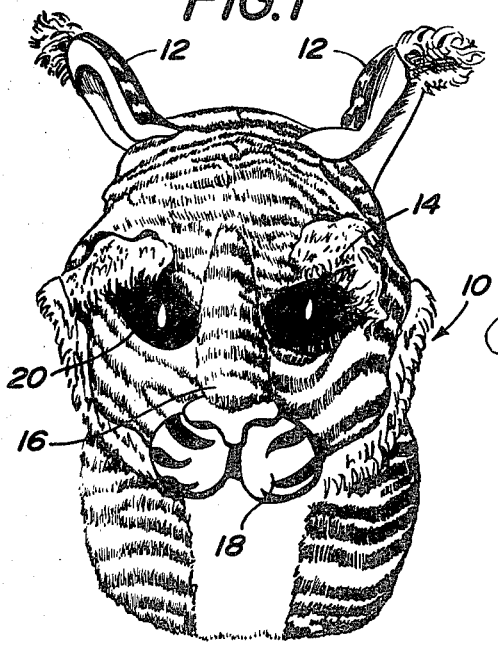
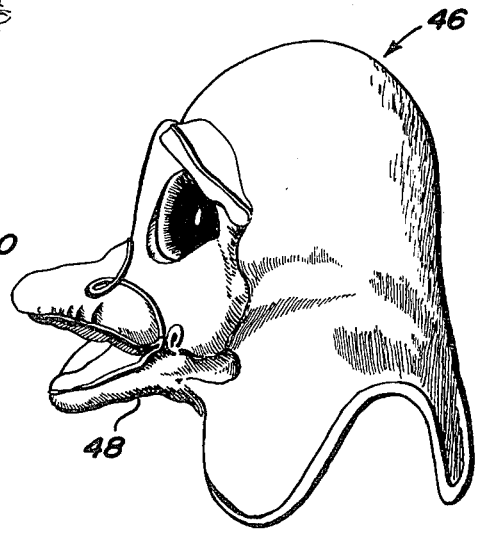
FIG. 4

FIG. 8
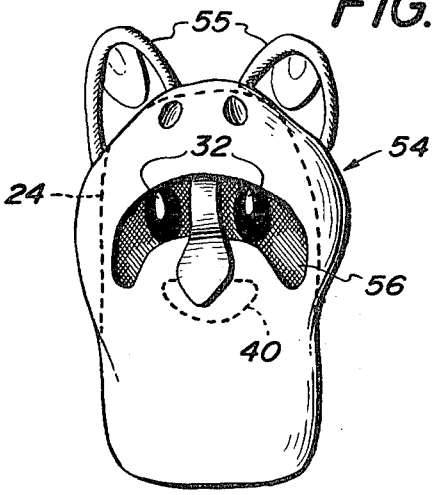
FIG. 9
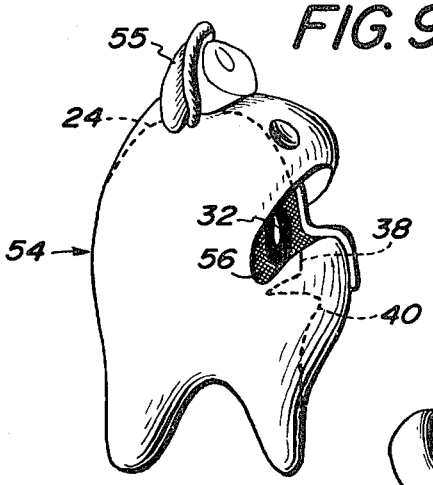
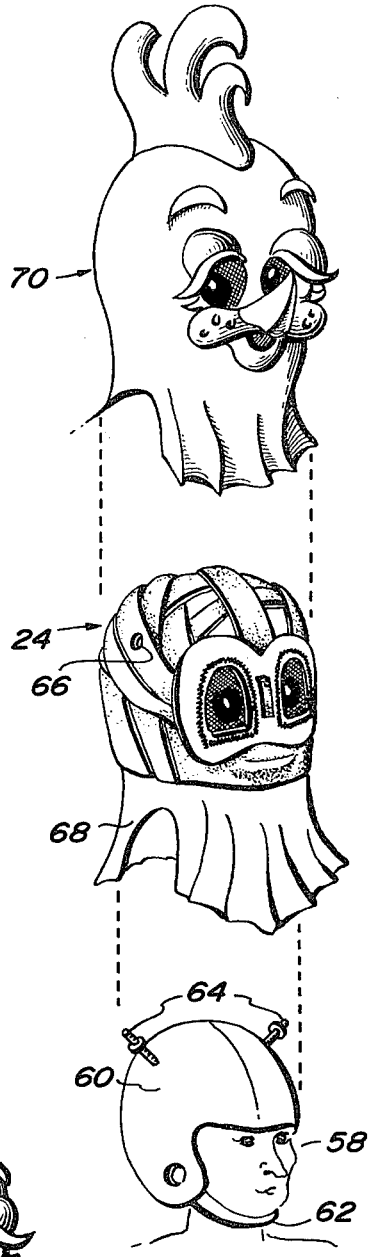
FIG. 10
FIG. 12
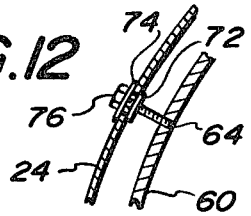
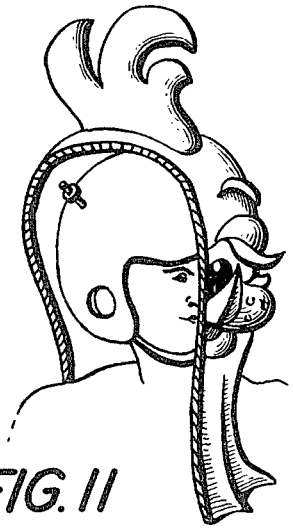
FIG. 11

COSTUME MASK ARMATURE

BACKGROUND OF THE INVENTION

1. Field of the Invention

This invention relates to apparel and more particularly to mask head coverings.

2. Description of the Prior Art

The wearing of face masks or costume heads survives from ancient times. Full head costume masks have traditionally been made of paper mache, which may be dried to form a lightweight, semirigid mask, or from material alone, or combinations of material and wire or cardboard, etc. Recent patents such as U.S. Pat. No. 4,175,411 to Allen et al are directed to thin slabs of foamed elastomeric sections which may be folded together to form a head covering and which includes nose and mouth openings. Another example is U.S. Pat. No. 2,914,772 to Lemelson which is a mask made of construction or the like paper with cutouts for eyes, nose, mouth and eyebrow features, which may be fastened, for example snapped on, the mask itself. U.S. Pat. No. 2,666,204 to Mafko discloses a face mask with an attachable nose which doubles as a noisemaker.

Armatures are not unknown in the costume art where, for example, U.S. Pat. No. 3,359,570 to Rodgers discloses reversable doll armature intended to support the head of the doll.

Notwithstanding the ancient history of masks, the large, over-the-head masks associated with, for example, animal costumes are still largely paper mache which has been painted or cloth covered for a permanent costume piece.

In the costume rental market or in circumstances in which a person may desire to wear a costume repeatedly, such as for a promotional appearance, the costume head becomes subject to wear and grime which is not easily removed and which renders the costume both unsightly and sometimes unsanitary.

Moreover, the costume masks of the aforementioned variety are generally expensive to create and there is therefore a limited market for them at a time when, conversly, the interest in costumes for parties or mardi gras celebrations is ever increasing.

There is, therefore, a need for a universal costume armature which adapts itself easily to a variety of costume masks or coverings yet which is easily assembled, adaptable to all sizes and figures of wearers, and which may be replaced without the necessity of replacing the expensive mask covering.

SUMMARY OF THE INVENTION

The aforementioned prior art problems are solved by the universal costume mask armature of this invention in which a rigid generally continuous infrastructure, capable of overfitting a human head, is provided. The infrastructure, or armature, includes a skull-shaped cranium and a face portion of novel construction. The face portion is preferably generally flattened and includes a pair of eye ports. A nose plate between the eye ports forms a continuation of the face and serves to receive and support the nose features of a mask mounted on the armature. In the preferred embodiment, the nose plate is provided with one-half of a pair of fastening means, the other half of which is fastened to the mask nose underside. The face portion also includes an maxilary plate which is located below the nose plate and spans the width of the face from under the eyes. This flattened section is designed to receive and support upper lip features of a mask.

A third important featue of the armature is a chin plate located below the maxilary plate and discontinuous from it to provide a mouth and breathing port. The chin plate projects slightly, extending further forward from the face than the maxilary plate and this is an important feature which enables chin and jowl features of the mask to be adequately supported.

The armature thus described is truly universal in that it will adequately support costume masks of almost infinite variation and design. That is to say, whether the costume mask is a tiger, duck, frog, spaceman or whatever bizarre design, the armature will support them all equally well.

The armature of this invention may include a shoulder brace to enable the armature to be rested upon the wearer's shoulders or, in the alternative, the armature may be mounted upon a helmet to permit the weight to be carried by the head of the wearer, leaving the shoulders free to facilitate turning the head.

It is, therefore, an object of this invention to provide a universal costume mask armature for the human head.

It is yet another object of this invention to provide the aforesaid armature as a lightweight, easy to construct, universal fit structure.

It is still another object of this invention to provide an armature with a face portion designed to accept and support costume masks which, themselves, include an infinite variation in nose, eyebrows, chin, jowls and cheek features.

It is yet another object of this invention to provide an armature which is interchangeable with costume masks to allow masks to be readily removed, for cleaning and storage.

It is yet another object of this invention to provide the aforesaid structure to allow eye and mouth ports to be used interchangeably within a single armature, thereby increasing yet again the type of mask which will be accommodated by the armature.

These and other objects will be more readily ascertainable to one skilled in the art from a consideration of the following figures, description and exemplary embodiments.

BRIEF DESCRIPTION OF THE DRAWING(S)

FIG. 1 shows a front elevation of a mask covered armature of this invention.

FIG. 2 shows the armature of this invention in back elevation partially covered by a mask.

FIG. 3 is a side elevation of the mask and armature with the mask partially cutaway to reveal the internal structure.

FIG. 4 shows a side view of a mask being used with the armature of this invention.

FIG. 8 is a front elevation of the armature of this invention with yet another mask overfitting it.

FIG. 9 is a side elevation of the view shown in FIG. 8.

FIG. 10 is an exploded view of an alternate embodiment of this invention showing the component parts of the armature in use.

FIG. 11 is a cutaway view of a mask and armature illustrated in FIG. 10.

FIG. 12 is a detail showing attachment of mask, armature and helmet of the embodiment shown in FIGS. 10 and 11.

DETAILED DESCRIPTION OF THE PREFERRED EMBODIMENT(S)

Figure 5:
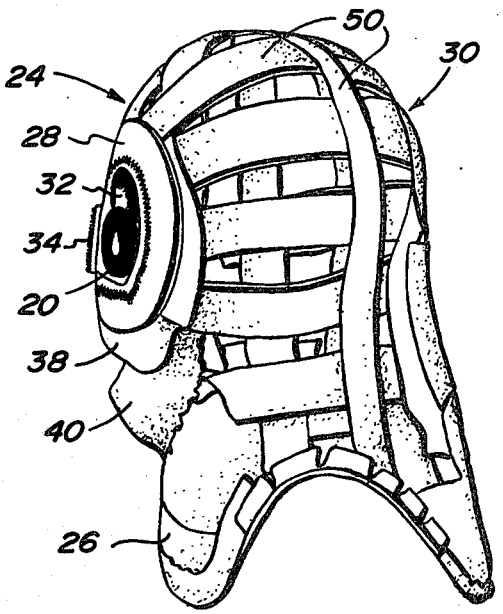
FIG. 5 is a side elevation of the armature of the invention.

Referring now to the drawings, and more particularly to FIG. 1, the costume mask armature of this invention is shown as it will appear in use. In FIG. 1, mask 10 of a tiger's head is shown in front view. Tiger mask 10 is made of a soft cloth material and it includes projecting features which, in the example of this Figure, are ears 12, eyebrows 14, nose 16 and whiskers 18. Mask 10 also includes foraminous eye covers 20.

Referring now to FIG. 2, a back view of mask 10 is shown including closing means 22 which, in this example, is a zipper and which is shown unzipped to reveal the back of armature 24 showing cranium 30. Also visible to some extent in FIG. 2 is the covered portion of shoulder support means 26 which forms an extension of the armature and which will be discussed in more detail in subsequent Figures.

Referring now to FIG. 3, a side elevation of armature 24 is shown with mask 10 cut away to reveal in more detail the parts of the armature. Armature 24 includes face 28. Face 28 is shown in this Figure in a side view and includes one of a pair of eye ports 32 covered with foraminous eye covers 20. Fastener 34 is shown mounted on a nose plate 36. Fastener 34 is actually a pair of velcro strips in this instance, one strip of which is attached to the underside of nose 16 of mask 10.

Maxilary plate 38 is located just below eye ports 32 and it may be seen in this view that maxilary plate 38 aids in supporting mask nose 16 and also upper lip features which, in this case, are whiskers 18. Below maxilary plate 38, chin plate 40, also forming part of armature 24, is located. Chin plate 40 supports jowl and chin features which are not an important part of the tiger mask 10, but which become more important in regard to the other masks such as the duck mask to be discussed in FIG. 4.

Shoulder support 26 is shown in more detail in FIG. 3 and includes a curved section 42 and a back rest plate 44 which are adapted to allow armature 24, through shoulder support means 26, to rest upon the user's shoulders.

Referring now to FIG. 4, a variation in the mask is shown to illustrate the versatility of the armature itself. In FIG. 4, duck mask 46 is shown in side view to accentuate the ability of armature 24 to support exaggerated nose and jowl features. In the example of duck mask 46, chin plate 40 is not visible by virtue of being covered with mask lower beak 48 which, in spite of its exaggerated features, is easily supported by the armature.

Referring now to FIG. 5, a side view of the armature itself is shown. In this view, cranium 30 is shown comprised of lattice strips 50 and the general skull-shaped infrastructure of cranium 30 and visible. Again, it may be seen that the armature includes not only cranium 30 but also face 28 including eye ports 32 covered with foraminous eye covers 20. In this view, fastener 34 is readily discernable as one-half of a velcro type fastener. Velcro refers to a conventional fastener, one part including barbs and the other loops which releasably mesh. Maxilary plate 38 is shown in spaced apart relationship from chin plate 40 and it is between these two parts that a mouth port is provided. Shoulder support means 26 are again shown, this time without the overcover of mask 10 or 46, to reveal the means by which armature 24 is supported by the user.

Figure 6:
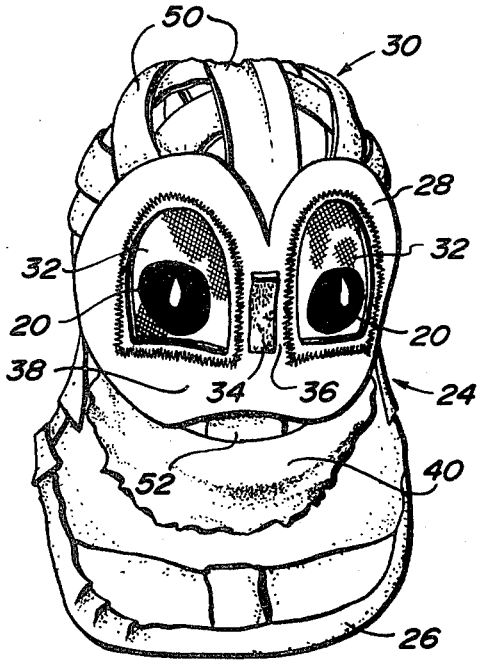
FIG. 6 is a front elevation of the armature of the invention.

Referring now to FIG. 6, the strange looking but wonderfully versatile armature 24 is shown in front view. In this view, face 28 appears as somewhat heart-shaped and it may readily be seen that eye ports 32 are a pair and that nose plate 36 is a flattened plate and is designed to accommodate bulky features of the mask. In this front elevation, maxilary plate 38 is seen as a flattened portion, which configuration is best suited to supporting mask features. Chin plate 40 is shown spaced apart from maxilary plate 38 and in this view, foraminous mouth cover 52 is shown enclosing the space between plate 38 and plate 40.

Figure 7:
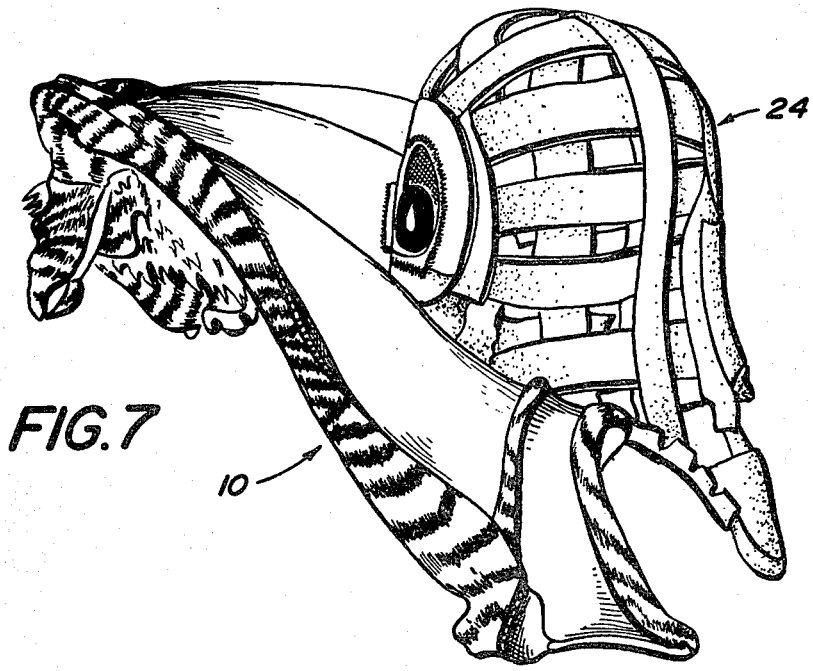
FIG. 7 shows a side elevation of the armature of the invention with a mask being attached thereto.

Referring now to FIG. 7, armature 24 is again shown in side view, this time illustrating the ease with which mask 10 may be overfitted and mounted on the armature.

Referring now to FIGS. 8 and 9, the versatility of this universal armature is illustrated. FIGS. 8 and 9 represent a front and a side view of a frog mask 54 mounted on the previously described armature. In FIGS. 8 and 9, mask 54 includes eye features 55, not as part of the armature, but rather as part of the mask. In this example, eye ports 32 correspond with the mouth portion 56 of mask 54. Thus, the user of armature 24 sees normally through eye ports 32, but is perceived by his audience as having a mouth in this location and not eyes.

Referring specifically to FIG. 9, maxilary plate 38 and chin plate 40 are shown in relationship to frog mask 54. In this example, plates 38 and 40 support frog chin features. It should be noted that the forward extension, or outward extension, of chin plate 40 aids the user's breathing by spacing the mask outward from the user to provide some inside room within the armature.

Referring now to FIG. 10, an alternate embodiment of the armature of this invention is shown to illustrate the armature's versatility in yet another area. In FIG. 10, an exploded view is shown in which user 58 utilizes an undersupport, or helmet, 60. Helmet 60 is secured to user 58 by chin straps 62. Helmet 60 includes armature fastening means, in this example bolts 64, which provides attachment for armature 24 through holes 66. In this embodiment, armature 24 is shown with neck cloth 68 which is merely free flowing material attached to the armature, and in some masks, may be dispensed with. It may thus be seen in this embodiment that the weight of armature 24 is supported by the head of the user and not by his shoulders. This is a great advantage in that it allows the head to turn freely and the user may thus view side to side as he normally would, and is not required to turn his entire body to see to the sides, as is the case in a shoulder-supported armature.

In the view shown in FIG. 10, mask 70 is a rooster mask including eyebrows, exaggerated nose and chin features as well as a cockscomb, all of which are easily and readily supportable on the universal armature.

FIG. 11 shows the helmet armature and mask of FIG. 10 in cutaway, one over the other, as they would appear in use.

Referring now to FIG. 12, the connecting means of helmet and armature are shown in more detail. Helmet 60 is shown as providing the stud for bolt 64. The connecting means includes stop 72 which appears below armature 24, and washer 74 and nut 76 make the connection.

There are many variations which may be practiced within the scope of this invention. Although a pair of eye ports is required to allow the wearer to perceive visually, the size of the eye ports is not critical and a foraminous or other see-through mask for the eye ports is optional.

The armature itself may be constructed of any material which is rigid, including resin or plastic dip cloth strips which are formed over a mold or the armature may be formed in one continuous piece. What is important is that the armature be both rigid and lightweight.

The most important feature of this invention relates to the face portion. The nose plate of the face portion, located between the eye ports, is to receive the nose features and therefore it must be rigid and preferably flat and, further, may include fastening means to attach this portion to a mask underside. The fastening means may be of any type which will accomplish the purpose although velcro is preferred.

It is also very important that the maxilary plate also be rigid to support upper lip features and that the chin plate, located below the maxilary plate, be spaced apart from it and to project outwardly therefrom. This particular configuration is essential to this invention because it has been discovered that this configuration is the one best suited to provide the versatility and universality of the armature. The spaced apart relationship between the chin plate and the maxilary plate which forms the mouth port may optionally contain a foraminous cover to allow breathing but hide the wearer from his viewers.

This armature is most suitable for full costume applications but may be used alone. By this is meant, the characters with exaggerated heads and features which appear frequently today in carnivals and parades and as promotional stunts will benefit greatly from the armature of this invention in that the armature provides the support for an infinite variety of masks, yet is adaptable to being shoulder mounted or head mounted and will readily form a part of an entire costume intended to cover the user's body.

Having now illustrated this invention, it is not intended that such illustration and description limit this invention, but rather that this invention be limited only by a reasonable interpretation of the apended claims.

What is claimed is:

1. A universal costume mask armature for the human head comprising a rigid, generally continuous infrastructure of a size to overfit and substantially envelope a human head, said structure including a skull-shaped cranium and a face portion continuous therewith, said face portion including:

(a) a pair of eye ports positioned thereon to allow a wearer to perceive visually therethrough;

(b) a nose plate located between said eye ports and adapted to receive and support a mask nose feature;

(c) a maxilary plate located below said nose plate and spanning the width of said face below said eye ports to aid in supporting said mask nose and also mask upper lip features; and, (d) a chin plate forming part of said infrastructure and located immediately below, discontinuous, and spaced apart from said maxilary plate and projecting outwardly therefrom, said chin plate adapted to receive and support mask lower lip/jowl features.

2. The armature according to claim 1 wherein said face portion is generally flattened.

3. The armature according to claim 1 wherein said cranium portion comprises a lattice structure to reduce weight and increase ventilation.

4. The armature according to claim 1 further comprising a mouth port located between said chin plate and said maxilary plate.

5. The armature according to claim 4 wherein said eye and mouth ports include a foraminated cover.

6. The armature according to claim 1 including, additionally, a removable, pliable mask including at least one projecting feature selected from the group consisting of ear, nose, beak, lips, cheeks and eyebrows.

7. The armature according to claim 1 wherein said nose plate includes fastening means to releasably grasp and hold a nose feature of a mask mounted thereon.

8. The armature according to claim 7 wherein said fastening means comprise a mated pair of fasteners, one of which is permanently mounted on said nose plate and the mate of which is attached to said mask underside at said nose feature.

9. The armature according to claim 1 wherein said armature is adapted to rest and be supported upon the wearer's shoulders.

10. The armature according to claim 1 wherein said armature includes, additionally, a helmet and means to attach said infrastructure to said helmet to allow said armature to be supported by said helmet during use so that said wearer may have unrestricted neck movement.

* * * * *